US008303281B2

(12) United States Patent
Robillard

(10) Patent No.: US 8,303,281 B2
(45) Date of Patent: Nov. 6, 2012

(54) GEAR TYPE PERFORMANCE OIL PUMP

(75) Inventor: Bruce Robillard, Amprior (CA)

(73) Assignee: Clay Valley Holdings Inc., Arnprior (CA)

( * ) Notice: Subject to any disclaimer, the term of this patent is extended or adjusted under 35 U.S.C. 154(b) by 733 days.

(21) Appl. No.: 12/502,616

(22) Filed: Jul. 14, 2009

(65) Prior Publication Data

US 2011/0014080 A1 Jan. 20, 2011

(51) Int. Cl.
*F04C 2/00* (2006.01)
*F04C 27/02* (2006.01)

(52) U.S. Cl. ..... 418/102; 418/88; 418/94; 418/178; 418/206.7; 418/206.8

(58) Field of Classification Search ..... 418/88, 418/94, 102, 178, 179, 206.1–206.9
See application file for complete search history.

(56) References Cited

U.S. PATENT DOCUMENTS

| | | | | | |
|---|---|---|---|---|---|
| 2,096,870 | A | * | 10/1937 | Vollenbroich | 418/102 |
| 2,756,684 | A | * | 7/1956 | Renzo | 418/102 |
| 3,059,396 | A | * | 10/1962 | Thees | 418/206.8 |
| 3,363,577 | A | * | 1/1968 | Heijnis | 418/102 |
| 3,994,634 | A | * | 11/1976 | Riddle et al. | 418/102 |
| 5,810,571 | A | | 9/1998 | Cross et al. | |
| 6,309,199 | B1 | * | 10/2001 | Devine | 418/206.7 |

* cited by examiner

*Primary Examiner* — Theresa Trieu
(74) *Attorney, Agent, or Firm* — Greer, Burns & Crain, Ltd.

(57) ABSTRACT

A high performance gear type oil pump for an internal combustion engine which has drive and driven gears which are, on one common side of the gears, respectively supported from the housing by a drive shaft and an idler shaft. In order to avoid cantilevering of the gears when generating pressurized oil, the other common side of the gears are each rotatable mounted on stub axles or pins which themselves are fixedly attached to the housing. In order to minimize wear, oil under pressure is supplied to the bearing surfaces of stub axles or pins which extend interiorly of the gears and also to the bearing surfaces of the housing which faces the common side of the gears where the stub axles are located, through oil supply passageways in the stub axles or pins.

7 Claims, 3 Drawing Sheets

GEAR TYPE PERFORMANCE OIL PUMP

FIELD OF THE INVENTION

This invention relates to high performance oil pumps as commonly used in performance or competition internal combustion engines.

BACKGROUND OF THE INVENTION

Oil pumps as conventionally used in internal combustion engines are of the gear pump type in which the teeth of a drive gear mesh with teeth of a driven gear within a cavity provided in the oil pump housing. One side of the drive gear is axially rotated by a drive shaft which extends through the housing whilst the corresponding side of the driven gear is axially supported for rotation from said housing on an idler shaft. During rotation of the gears within the housing cavity, oil is drawn into the cavity in an area where the teeth of the meshing gears diverge while oil under pressure is discharged from the cavity in an area where the teeth of the meshing gears converge.

As disclosed by Gary A. Cross et al. in U.S. Pat. No. 5,810,571 which issued on Sep. 22, 1998, a preferred form of high performance oil pump construction, in order to minimize wear in the oil pump while generating high oil flow necessary to lubricate an engine rotating at high RPM requires, inter alia, drive and driven pump gears that are rotatably supported on shafts within bearings located on the opposite side of the two gears. As disclosed in this patent, the gear shafts of the drive and driven gears which rotate with the drive and driven gears have the shafts on the upper side of the gears supported in the upper housing of the pump while the gear shafts on the opposite side of the gears are rotatably supported in bearing bores provided in the lower pump housing.

Since the weight of a performance or competition internal combustion engine is of importance, the oil pumps used in them normally employ an aluminum housing with the drive and driven gears and their associated shafts being fabricated from steel. An inherent shortcoming which exists in high performance aluminum oil pumps as disclosed in the '571 patent, is that the ends of the bearing shafts of the steel drive and driven gears which are rotatably received in the bearing bores provided in the lower aluminum housing, even though they are subjected to direct lubrication, can become enlarged and oval in shape due to a cantilevering effect experienced at the bottom end of the drive and driven gears which undergo significant stress when producing, within the housing, large quantities of lubricating oil under high pressure.

SUMMARY OF THE INVENTION

As noted above, the oil pump assembly of this invention is of the type having teeth of a drive gear meshing with teeth of a driven gear within a cavity provided in a housing, and wherein one side of the drive gear is axially rotated by a drive shaft extending through the housing and a corresponding side of the driven gear is axially supported for rotation from the housing on an idler shaft, so that during rotation of the gears, oil is drawn into the cavity in an area where the teeth of the meshing gears diverge and where oil under pressure is discharged from the cavity in an area where the teeth of the meshing gears converge.

The improvement found in this invention over oil pumps of the foregoing description, as well as those having the oil pump assembly as disclosed in U.S. Pat. No. 5,810,571 where the gear shafts located on the opposite side of the drive and driven gear are rotatably supported in bearing bores provided in the lower pump housing, resides in the provision of two axial bores which each extend inwardly respectively from the common opposite sides of the drive and driven gears and which accommodate two stub axles that are each fixedly attached to the housing and that are respectively received in the axial bores provided in the drive and driven gears.

Because the stubs axles are fixed to the housing, i.e. in a non-rotating manner, even in applications where the housing is made of aluminum, the likelihood of the steel axles in their bearing seats in the aluminum housing enlarging due to stresses experienced by them from the gears rotating at high speeds, is obviated or greatly reduced. For lubrication purposes, passageways are provided in the housing and the stub axles themselves, for the purpose of supplying pressurized oil discharged from the cavity, to the axial bores of the drive and driven gears, so as to lubricate the exterior bearing surfaces on the axles and the opposite side surfaces of the drive and driven gears.

In accordance with another aspect of this invention, the drive shaft and the driven shaft can be carried by the upper housing section of the assembly, with the cavity being defined by an interior of the upper housing section, such that the drive and driven gears are located in the interior of the cavity. One end of each of the two stub axles is fixedly attached to a lower housing section with the other free end, of each stub axle, extending into different ones of the axial bores which are provided in the opposite sides of the drive and driven gears.

When used in competition or racing applications, the upper and lower housing sections are preferably made from aluminum, with the cavity in the upper section advantageously being provided with a steel liner insert. A steel bearing plate for the opposite (lower) sides of the drive and driven gears can also be advantageously positioned between the upper and lower housing sections. Since the drive and driven gears and their associated shafts, like the bearing plate, are similarly made of steel, a higher degree of wear resistance is achieved between the lubricated steel to steel surfaces, then steel to aluminum.

In situations where a steel liner insert is employed within the cavity of the upper housing section, it is possible, prior to fitment of the liner within the cavity, to provide an oil supply channel in the interior wall of the aluminum upper housing section, which when covered over with the steel liner when positioned in the cavity, forms a passageway for supplying pressurized oil discharge from the cavity, to a bearing surface on the drive shaft in an area where it extends through the housing.

In accordance with yet another aspect of this invention, the passageways in the housing and the stub axles used to supply pressurized oil discharge from the cavity to the axial bores in the drive and driven gears, can also include an outlet passage which extends through the steel bearing plate from an area in the cavity where the teeth of the rotating gears converge (i.e. where oil under pressure is produced) that communicates with channels in the lower housing section and with axially aligned discharge bores in each of said stub axles. Additionally, the channels in the lower housing section can also communicate with an oil pressure release valve provided in an oil escape passageway provided in the lower housing section, whereby, when the valve is open, the oil in the oil escape passageway is rendered in fluid communication with oil that is being drawn into the cavity. The use of the steel liner and steel bearing plate results in a steel to steel interface between the teeth of the gears and the surrounding cavity liner, between one common side of the two gears with the liner, and between the opposite sides of the gears with the bearing plate, and all of which is incorporated in a lightweight housing of aluminum.

In accordance with yet another aspect of this invention, in order to maintain the stub axles in their fixed location in the lower housing section, the steel bearing plate through which the free ends of the stub axles extend can be used as a locking mechanism. Since each stub axle can include a surrounding collar which is received in a recess provided in an upper surface of the lower housing section, the collar abuts an underside of the overlying steel bearing plate through which their free ends extend. As a result, upward and lateral displacement of the stub axles which are affixed to the lower housing section is avoided, due to the locking action of the steel bearing plate.

BRIEF DESCRIPTION OF THE DRAWINGS

In the accompanying drawings which illustrate different aspects of my invention.

DETAILED DESCRIPTION OF THE DRAWINGS

Figure 1:
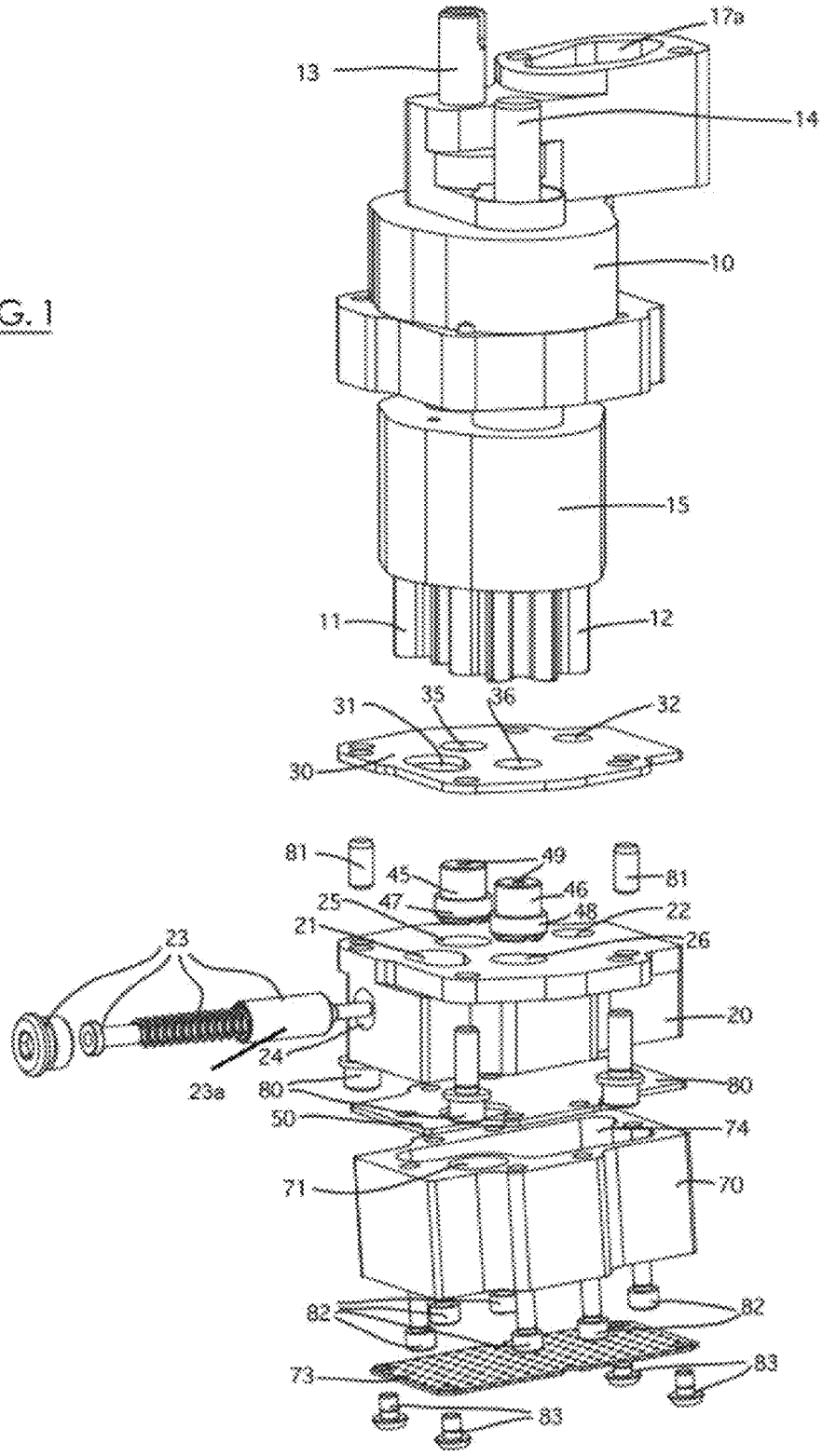
FIG. 1 is an exploded top perspective view of the oil pump of this invention.

Like most conventional gear type oil pumps, and as best seen in FIG. 1, the oil pump housing is made up of an upper housing section 10 and lower housing 20 with the drive gear 11 and driven gear 12 being located internally of upper housing 10. Drive shaft 13 which extends through the upper housing 10 is attached to drive gear 11 and upon rotation, causes driven gear 12 to rotate in the opposite direction on idler shaft 14. As described in greater detail below, oil is drawn through oil inlet 21 in the lower housing 20 into the cavity of the upper section 10 in an area where the drive and driven gears are housed when the rotating teeth of the meshing gears diverge (as illustrated in FIG. 1, when the drive gear rotates clockwise and the driven gear counter clockwise), and oil under pressure is discharged from the housing cavity through oil discharge port 17*a* located in an area of the upper housing where the teeth of the meshing gears converge.

Figure 5:
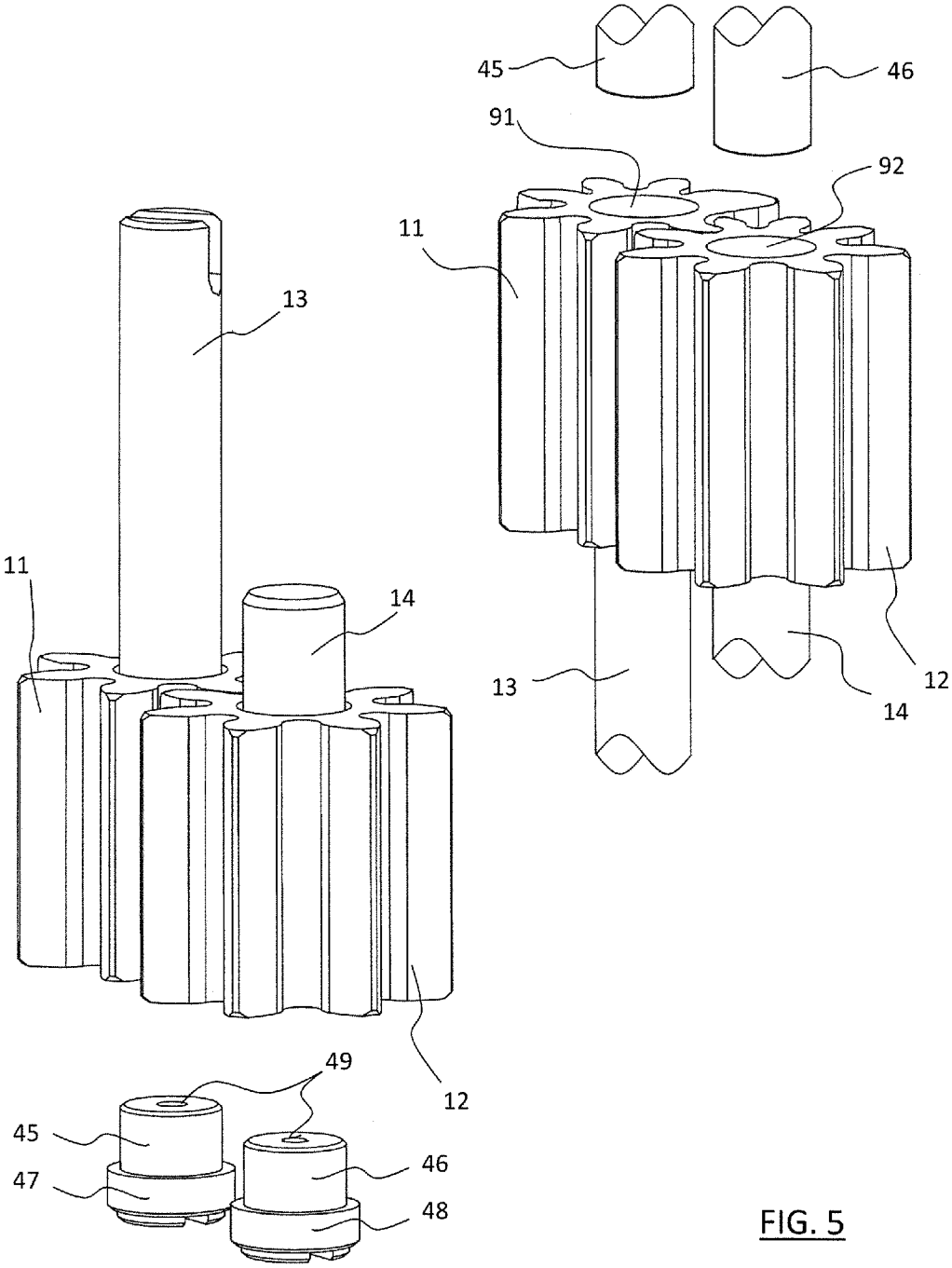
FIG. 5 depicts exploded views of the drive and driven gears with their shafts and the lower stub axles or bearing pins about which they rotate.

In accordance with one aspect of this invention, the sides of the drive and driven gears 11 and 12 opposite the drive and idler shafts 13 and 14, in their axial bores 91 and 92 are rotationally supported on stub axles or pins 45 and 46 illustrated in FIGS. 1 and 5. Collars 47 and 48 surround the stub axles or pins 45 and 46 and which are themselves positioned in receiving bores 25 and 26 provided in the upper surface of lower housing section 20. The upper or free ends of stub axles or pins 45 and 46, as seen in FIG. 1, respectively extend through bores 35 and 36 provided in bearing plate 30 when the upper and lower housing sections 10 and 20 are joined together by means of attachment screws 80 and alignment dowels 81, with bearing plate 30 located therebetween. Stub axles or pins 45 and 46 are fixedly held in position in bores 25 and 26 since the holes 35 and 36 in bearing plate 30 abut collars 47 and 48. As the gears 11 and 12, bearing plate 30 and stub axles or pins 45 and 46 are made of steel, when bearing on one another, their resistance to wear is far greater than that of steel on aluminum. Since stub axles or pins 45 and 46 are effectively locked in position in bores 25 and 26 of the aluminum lower housing 20 by means of the steel bearing or wear plate 30 which holds these axles in position, a bearing interface between steel drive and driven gears 11 and 12 with the top aluminum surface of lower housing 20 is avoided, and the unwanted enlargement of the bores 25 and 26 obviated.

Figure 2:
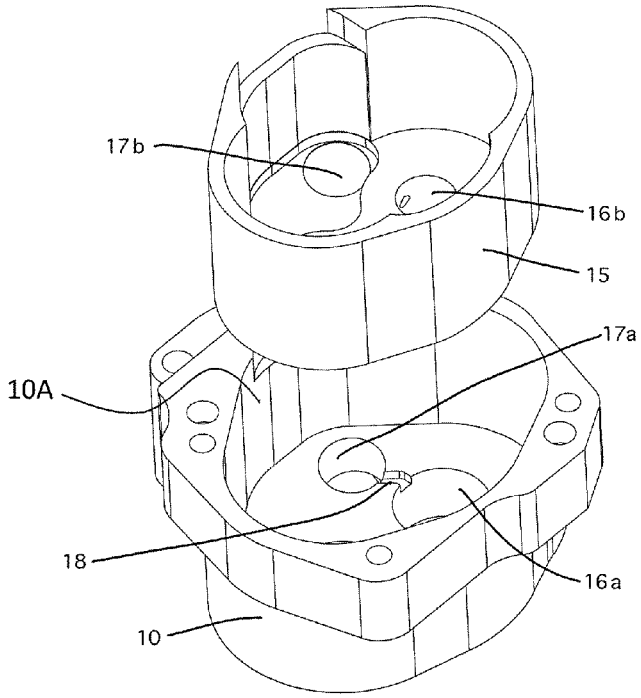
FIG. 2 is an exploded bottom perspective view of the cavity and liner in the upper housing section.

Referring now to FIGS. 1 and 2, a liner 15 fabricated from steel can be received within the cavity 10A of the upper housing section 10. As best seen in FIG. 2, bearing bore 16*a* in upper housing section 10 for the drive shaft also includes a cut-out channel 18 which communicates with pressurized oil discharge port 17*a*. When liner 15 is inserted into the cavity 10A of upper housing section 10, channel 18 is covered over by that portion of the liner between pressurized oil discharge port 17*b* which is in alignment with discharge port 17*a*, and bore 16*b* in the liner which forms a bearing surface for drive shaft 13. As a result, discharge oil under pressure is supplied to bearing shaft 13 for lubrication purposes through channel 18.

Figure 3:
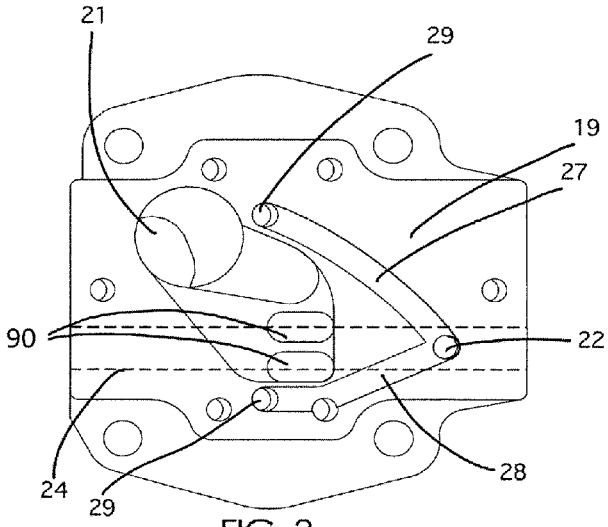
FIG. 3 is a bottom plan view of the lower housing section.
Figure 4:
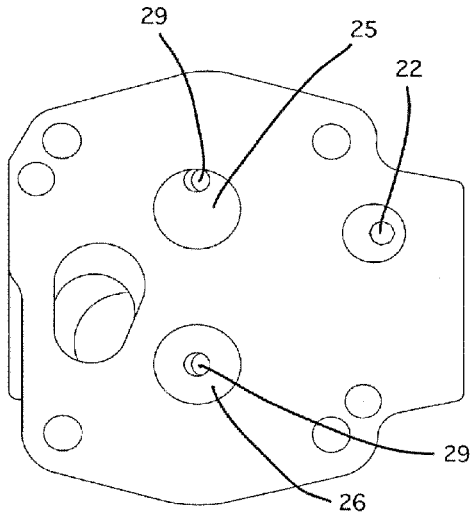
FIG. 4 is a top plan view of the lower housing section.

As stub axles or pins 45 and 46 rotationally support drive and driven gears 11 and 12 by means of axial bores 91 and 92 provided on the underside of the gears (not shown in FIGS. 1 and 2 but depicted in FIG. 5), lubrication of the bearing surface of the axles or pins with the bores of the gears is essential. This is achieved through the supply of pressurized oil which is generated in the upper housing section by the rotating gears, flowing through outlet passage 32 in wear plate 30 and overlying passageway 22 provided in and extending through lower housing 20 as illustrated in FIGS. 1 and 3. Internally of lower housing 20, passageway 22 communicates with oil relief valve passageway 24 which supports pressure relief valve assembly 23 which is positioned therein and functions in a manner as is well known in the art.

As illustrated in FIG. 3, the underside of the bottom housing section 20 is provided with a planer flat surface 19 which receives blanking plate 50 as illustrated in FIG. 1. Recessed channels 27 and 28 are provided in flat surface 19 and communicate with two oiler bores 29 as illustrated and which extend through the body of lower housing 20. When blanked off by plate 50, pressurized oil supplied through bore 22 is permitted to flow along channels 27 and 28 then upwardly through oiler bores 29 located at the ends thereof. As seen in FIGS. 1 and 5, stub axles or pins 45 and 46 are themselves provided with oil supply passageways 49 which are in communication with oil supplied from oiler bores 29 in lower housing 20.

Because the distance between an engine block (not shown) to which the oil pump is attached, and the bottom of the oil pan of the engine (also not shown) can vary, the lower housing section 20 can have attached to it by means of securing screws 82, an oil pickup section 70 of differing depths in order to locate the bottom end of the oil pump including the pickup component, as close to the bottom of the oil pan as possible. The interior 74 of pick up 70 is effectively hollow and at its open bottom end has attached to it screen 73 which is held in position by means screws 83.

In operation, oil in the pan during rotation of drive and driven gears, is drawn into interior 74 and then flows through oil inlet 71 in pickup 70, oil inlet 21 in lower housing 20, and then through inlet 31 provided in wear or bearing plate 30 to the rotating gears in the upper housing in the area of their gear divergence. The major portion of pressurized oil is discharged from the side of the cavity 10A of the upper housing 10 in which the meshing gears converge during rotation through pressurized oil discharge port 17*a*. As noted above, a minor portion of this pressurized discharge oil passes through channel 18 located between the upper housing portion 10 and liner

15 in order to lubricate drive shaft 13 where it extends through bore 16*b* in the liner 15 and bore 16*a* in the upper housing 10. As also noted above, pressurized oil generated in the upper housing section 10 is also permitted to pass through outlet passage 32 in wear plate 30, opening 22 in lower section 20 and then pass along channels 27 and 28 provided in the bottom side of lower housing 20 and which are covered over by blanking plate 50, to oiler bores 29 and thence through the oil supply holes 49 provided in each of stub axles or pins 45 and 46. Pressurized oil discharged through holes 49 lubricates the bearing interface between the pins which are received in the axial bores of the drive and driven gears and the interface of the sides of these gears with wear plate 30.

In situations where excessive and unwanted high oil pressure is experienced, the pressure relief valve assembly 23 which is located in passageway 24 and which communicates with bore 22 in the lower housing section, undergoes sufficient compression so as to permit pressurized oil in passageway 24 to exit from the passageway through discharge ports 90, which when covered over with blanking plate 50, communicate with oil inlet 21.

It has been found that when recycling oil which has passed through the pressure relief valve assembly back through oil inlet port 21 in lower housing 20, jamming or sticking of the valve 23*a* in an open or partially open position within the passageway 24 can occur when using only a single discharge port. This unwanted drawback has been overcome by using two discharge ports 90 as illustrated in FIG. 3. The use of the two discharge ports 90 which communicate with inlet port 21 is believed to better balance the oil undergoing pressure relief as it flows past valve 23*a*, and thereby, avoids jamming or sticking of the valve in passageway 24.

Oil pumps constructed with the fixed stub axles or pins for the drive and driven gears and which are lubricated in the manner described above, result in high performance pumps which are both robust and resistant to wear.

The invention claimed is:

1. In an oil pump assembly of the type having teeth of a drive gear meshing with teeth of a driven gear within a cavity provided in a housing and in which one side of the drive gear is axially rotated by a drive shaft extending through said housing and a corresponding side of said driven gear is axially supported for rotation from said housing on an idler shaft so that during rotation of the gears, oil is drawn into the cavity in an area where the teeth of the meshing gears diverge and oil under pressure is discharged from the cavity in an area where the teeth of the meshing gears converge, the improvement comprising:

a) two axial bores which each extend inwardly respectively from an opposite side of said drive gear and from a corresponding opposite side of said driven gear;

b) two stub axles each fixedly attached to said housing and respectively received in the said axial bores of said drive and driven gears; and c) first passageways in said housing and said stub axles for supplying pressurized oil discharged from said cavity to said axial bores so as to lubricate exterior bearing surfaces on said stub axles and on said opposite sides of said drive and driven gears.

2. In an oil pump assembly of the type as claimed in claim 1, said drive shaft and said idler shaft being carried by an upper housing section of said assembly; said cavity being defined by an interior of said upper housing section; said drive and driven gears being located in said interior of said upper housing section; one end of each of said stub axles being fixedly attached to a lower housing section of said assembly, and another end of each of said stub axles extending into different ones of said two axial bores.

3. In an oil pump assembly of the type as claimed in claim 2, wherein said upper and lower housing sections are aluminum, said cavity in said upper housing section includes a steel liner, and wherein a steel bearing plate for said opposite sides of said drive and driven gears is positioned between said upper and lower housing sections.

4. In an oil pump assembly of the type as claimed in claim 3, including a passageway between said aluminum upper housing section and said steel liner for supplying pressurized oil discharge from said cavity to a bearing surface on said drive shaft that extends through said housing.

5. In an oil pump assembly of the type as claimed in claim 4, said first passageways in said housing and said stub axles including an outlet passage extending through said steel bearing plate that communicates with channels in said lower housing section and with axially aligned oil discharge bores in each of said stub axles.

6. In an oil pump assembly of the type as claimed in claim 5, said channels in said lower housing section further communicating with an oil pressure release valve in an oil escape passageway provided in said lower housing section whereby when said release valve is open, said oil escape passageway is in direct fluid communication with oil which is drawn into said cavity.

7. In an oil pump of the type as claimed in claim 6, wherein said stub axles each extend through apertures in said steel bearing plate and each include a surrounding collar which abuts an underside of said steel bearing plate through which said stub axles extend.

* * * * *